US007478917B2

(12) United States Patent
Yu

(10) Patent No.: US 7,478,917 B2
(45) Date of Patent: Jan. 20, 2009

(54) PIVOTING FLASHLIGHT

(76) Inventor: Sun Yu, 2850 Coolidge Hwy., Berkley, MI (US) 48072

( * ) Notice: Subject to any disclaimer, the term of this patent is extended or adjusted under 35 U.S.C. 154(b) by 125 days.

(21) Appl. No.: 11/347,107

(22) Filed: Feb. 3, 2006

(65) Prior Publication Data

US 2007/0183145 A1 Aug. 9, 2007

(51) Int. Cl.
*F21L 4/00* (2006.01)

(52) U.S. Cl. ..... 362/188; 362/269

(58) Field of Classification Search ..... 362/119, 362/116, 120, 109, 187, 188, 190, 194, 197, 362/199, 200, 202, 205, 208, 269; 30/119
See application file for complete search history.

(56) References Cited

U.S. PATENT DOCUMENTS

| | | | | |
|---|---|---|---|---|
| 2,762,907 | A * | 9/1956 | Schwartz | 362/201 |
| 4,914,748 | A | 4/1990 | Schlotter, IV et al. | |
| 5,410,457 | A * | 4/1995 | Parker | 362/205 |
| 5,541,822 | A * | 7/1996 | Bamber | 362/190 |
| 5,626,414 | A * | 5/1997 | Chen | 362/119 |
| 5,716,121 | A * | 2/1998 | Dubois | 362/198 |
| 6,260,453 | B1 * | 7/2001 | Anderson et al. | 81/440 |
| 6,260,979 | B1 * | 7/2001 | Lin | 362/119 |
| 6,283,607 | B1 * | 9/2001 | Lin | 362/119 |
| 6,334,693 | B1 * | 1/2002 | Lee | 362/119 |
| 7,063,435 | B2 * | 6/2006 | Dallas et al. | 362/119 |
| 7,195,371 | B2 * | 3/2007 | Thuma et al. | 362/199 |
| 2004/0211007 | A1 * | 10/2004 | Ping | 7/128 |

OTHER PUBLICATIONS

Nautilus Auto-Flashlight, http://www.gerbertools.com/lmg_L/9471.jpg, Oct. 17, 2005.
Gerber Nautilus 9471—GerberTools.com, http://www.gerbertools.com/8858.htm Oct. 17, 2005.

* cited by examiner

*Primary Examiner*—Hargobind S Sawhney
(74) *Attorney, Agent, or Firm*—Gifford, Krass, Sprinkle, Anderson & Citkowski, P.C.

(57) ABSTRACT

A flashlight is provided that includes a housing and a light assembly including a light source and a battery. A light activation switch is provided for selectively forming an electric circuit between the light source and the battery to induce light emission from the light source. A pivot engages both the housing and the light assembly to rotate the light assembly between a closed position and an open position relative to the housing. The housing provides a measure of protection to the light activation switch. A spring is provided to bias the light assembly towards either of the closed position or the extended position. In combination with the spring, a flip switch is added so that upon activation of the flip switch the spring moves the light assembly to an extended position. The rotation between extended and closed positions for the light assembly typically ranges between 80 and 200 degrees, and ideally greater than 140 degrees. With the addition of a set screw, an intermediate position between closed and open positions is also maintained.

18 Claims, 4 Drawing Sheets

PIVOTING FLASHLIGHT

FIELD OF THE INVENTION

The present invention in general relates to a miniature flashlight and in particular to a miniature flashlight having a spring switch that moves the light between a closed-inactive position and an extended-illuminated position.

BACKGROUND OF THE INVENTION

Miniature flashlights in recent years have shifted towards the use of a light emitting diode (LED) as the light source over incandescent bulbs. The net result is that power usage is more efficient and flashlights have become smaller and lighter even while the function remains the same. Miniature flashlights remain well suited for providing proximity lighting to perform tasks such as mating a key with a lock under poor ambient light conditions. Based on typical uses and the desire to remember to carry such a light, miniature lights have typically incorporated a key ring or spring clip. Unfortunately, because of the inadvertent pressure applied to a miniature flashlight within the confines of a pocket, or carrying article such as a purse, the switch for energizing the light is prone to inadvertent depression and concussion damage, with both phenomena limiting the useful lifetime of the flashlight.

Thus, there exists a need for a miniature flashlight having a protective housing overlying the light activation switch and a pivot about which to rotate the light relative to the housing to bring the light into an open position quickly.

SUMMARY OF THE INVENTION

A flashlight is provided that includes a housing and a light assembly slidable within the housing. The light assembly includes a light source and a battery. A light activation switch is provided for selectively forming an electric circuit between the light source and the battery to induce light emission from the light source. A pivot engages both the housing and the light assembly to rotate the light assembly between a closed position and an extended position relative to the housing. The housing provides a measure of protection to the light activation switch. Optionally, the spring is provided to bias the light assembly towards either of the closed position or the extended position. In combination with an optional spring, a flip switch is optionally added so that upon activation of the flip switch the spring moves the light assembly to an extreme position of open or closed. A keychain ring or other securement is optionally provided to afford ancillary uses for the light. The rotation between extended and closed positions for the light assembly typically ranges between 80 and 200 degrees, and preferably greater than 140 degrees. With the optional addition of a set screw, an intermediate position between closed and open positions is also maintained.

DETAILED DESCRIPTION OF THE PREFERRED EMBODIMENTS

The present invention has utility as a miniature flashlight. Through the mounting of a light assembly on a pivot relative to a protective housing, greater longevity is achieved, as compared to a conventional miniature flashlight. It is appreciated that operation of an inventive flashlight is facilitated through the inclusion of a spring to bias the light assembly towards either a fully extended or fully closed position relative to the housing. A flip switch is further optionally provided to release the spring and thereby move the light assembly between closed and extended positions, or vice versa. A light activation switch is readily triggered by the flip switch moving the light assembly into an open position such that upon flip switch activation the light assembly swings into an open position and automatically has a light emission from a light assembly light source.

Figure 1:
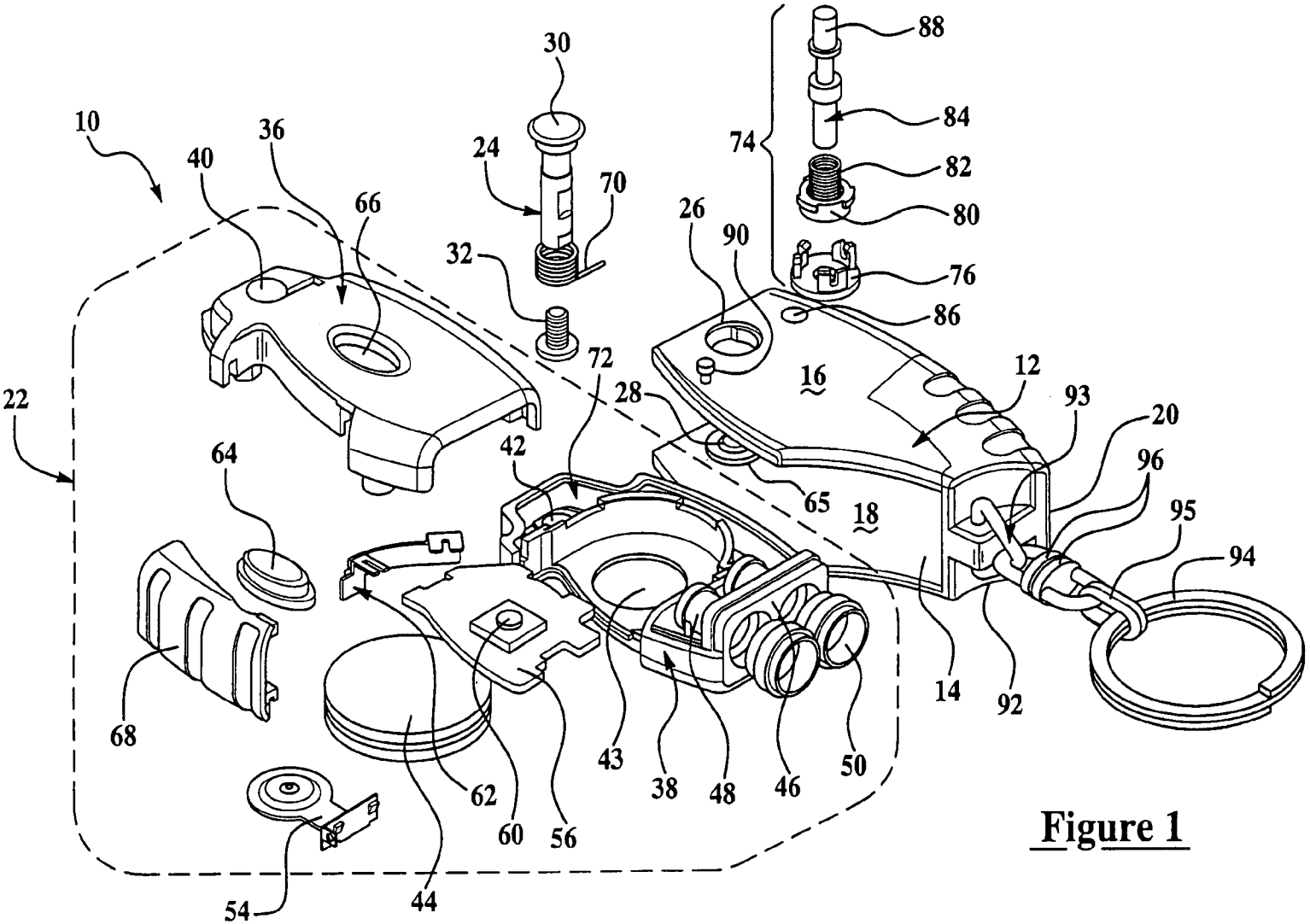
FIG. 1 is an exploded view of an inventive light in a closed position.

Referring now to the figures, an inventive flashlight is depicted generally at 10 where like numerals are used between various figures to describe a given aspect or component. The flashlight 10 has a housing 12 defining a volume 14. The housing 12 has two opposing walls 16 and 18 bounding the volume 14. A side 20 retains the opposing surfaces 16 and 18 in a fixed relationship, the volume 14 being dimensioned to receive a light assembly shown generally at 22 within the volume 14. The light assembly 22 is secured to the housing 12 by way of a pivot pin 24. The pivot pin 24 has a diameter able to insert within co-aligned apertures 26 and 28 formed within surfaces 16 and 18, respectively. A pivot pin cap head 30 retains the pin 24 in contact with aperture 26. A second pivot pin cap head 32 is secured to the pivot pin 24 in opposition to cap head 30 so as to secure the pivot pin 24 to surface 18 of the housing 12 and retain the pin 24 in secure contact with aperture 28. While cap head 32 is depicted in FIG. 1 as a threaded fastener engaging complementary threads within pivot pin 24, it is appreciated that a cap head is readily formed by flaring the pivot pin end in opposition to cap head end 30 such that pivot pin 24 is acting as a rivet.

The light assembly 22 is bounded by a shell made up of a first shell portion 36 and a complementary second shell portion 38, the shell portions 36 and 38 defining a volume. The first and second shell portions 36 and 38 are held together with adhesives or mechanical fasteners 39 such as screws or rivets. The shell portions 36 and 38, like the housing 12, are readily formed from a variety of materials, each illustratively formed from a material such as metals including steel, aluminum, brass, and pot metal; and plastics such as polycarbonate, polyacrylates, polystyrene, polyalkylenes, and block copolymers thereof. The first and second shell portions each has an aperture therein as shown at 40 and 42, respectively. Upon the first and second shell portions 36 and 38 being joined, the apertures 40 and 42 define a passage about which the light assembly 22 rotates on the axis of pivot pin 24. The second shell portion 38 has a recess 43 adapted to receive a battery 44 therein. A frame 46 simultaneously engages the first and second shell portions 36 and 38, the frame 46 securing a light source 48. Optionally, a reflector 50 is also secured to the frame 46 so as to encompass the light source 48. The light source 48 as depicted preferably includes multiple lighting elements. Lighting elements operative herein illustratively include light emitting diodes, incandescent bulbs, cold cathode ray tubes, and combinations thereof. Preferably, the lighting element is a light emitting diode. Still more preferably, two or more light emitting diodes are aimed to emit light emissions therefrom in a generally unidirectional fashion. The light source 48 is electrically connected to contact 54 that simultaneously forms an electrical contact underlying the battery 44. It is appreciated that the voltage required to power a light source 48 is dependent not only upon the nature of the light element but also in the case of light emitting diodes, the emission color. To accommodate variations in light source voltage requirements, it is appreciated that a battery 44, as depicted in FIG. 1, optionally includes multiple batteries operating in series. While the battery 44 is depicted as a button-type battery, as a preferred, compact embodiment, it is appreciated that other types of batteries are operative in an inventive flashlight with the understanding that the shape of the light assembly is necessarily modified to accommodate a battery of different dimensions. Other battery formats operative herein illustratively include AAA, AA, 9 volt, and the like.

Overlying the battery 44 is a switch plate 56 having a depression switch 58 thereon. The switch plate 56 is formed of an electrically insulative material. An electrical circuit is formed between the light source 48 and the battery 44 upon depression of the light activation switch 60 so as to induce light emission from the light source. Preferably, the second contact between the battery 44 and the light source 48 is not directly via switch 60 but rather through an intermediate contact 62. While the light activation switch 60 is depicted as a depression switch, it is appreciated that alternate switch types conventional to the art such as a slide switch are operative herein. An exemplary slide switch is detailed in U.S. Pat. No. 6,299,323. Preferably, an elastomeric switch cover 64 overlies the light activation switch 60. Switch cover 64 extends through a complementary aperture 66 formed in the first shell portion 36. Optionally, a bumper 68 formed of a semi-rigid elastomeric material simultaneously interlocks the first and second shell portions 36 and 38. The bumper 68, in addition to forming a convenient gripping surface, serves to dampen vibration associated with rotating the light assembly 22 into an open position as depicted in FIG. 2.

A common problem associated with flashlights is the inadvertent retention of the flashlight in an energized mode after storage thereby depleting the battery power supply. This problem is compounded with miniature flashlights where the light emission is difficult to detect under daylight lighting conditions. As an inventive flashlight 10 in a closed position has limited light emission escaping the housing 12, detecting the inadvertent light emission during storage is further complicated. In order to overcome this problem, inventive flashlight 10 in a preferred embodiment includes an automatic light source activation/deactivation feature. A switch depression contact 65 extends from the wall 16 into volume 14 at a position that intersects the switch cap 64 as the light assembly 22 is rotated from a closed position. While a contact 65 is as simple as a protruding portion on wall 16, a roller bearing is also optionally deployed as a contact 65, as depicted in FIG. 1. While the roller bearing as contact 65 is depicted in FIG. 1 on the edge of wall 16 for visual clarity, preferably the contact is located at a more internal position on wall 16 and extending into the volume 14. The contact 65 depresses the switch cover 64 and the underlying light activation switch 60 upon contact as the light assembly 22 is rotated into an open or intermediate position and thereby induces light emission. Upon rotating the light assembly into the closed position, contact 65 again contacts the switch cover 64 and deactivates the light activation switch 60 so as to deactivate the light source 48 prior to reaching a closed position. It is appreciated that upon extending the light assembly 22 into an extended or intermediate position that is activated by the contact 65, a user by depressing the switch cover 64 can deactivate the light source 48. Reactivating the light source prior to closure allows the contact 65 to automatically deactivate light source 48 upon closure.

In a preferred embodiment, the light assembly 22 is spring biased relative to the housing 12. A spring 70 located within a spring compartment 72 proximal to second shell portion 38 aperture 42 urges the light assembly 22 into either an extreme open or closed position depending on the orientation of the spring 70. More preferably, the spring 70 is oriented to urge the light assembly 22 into an open position. In embodiments of the inventive flashlight 10 having a spring-biased light assembly 22, a flip switch shown generally at 74 is provided to selectively retain the light assembly 22 in a tensioned position. As depicted herein, tension position is the closed position. The flip switch 74 includes a catch 76 adapted to engage a complementary recess 78 in shell portion 38. The catch 76 is rotatably secured to housing surface 18. Overlying the catch 76 and seating therein is spring seat 80 having a spring 82 mounted thereover. A flip switch pin 84 engages the spring 82 and extends through a complementary aperture 86 in the housing 12 to provide a depression button 88 for activating the flip switch 74. By depressing the button 88, the pin 84 transmits a downward force through intermediate components 82 and 80 to release the catch 76 from the recess 78 allowing the light assembly 22 to automatically flip into an open position.

Figure 2:
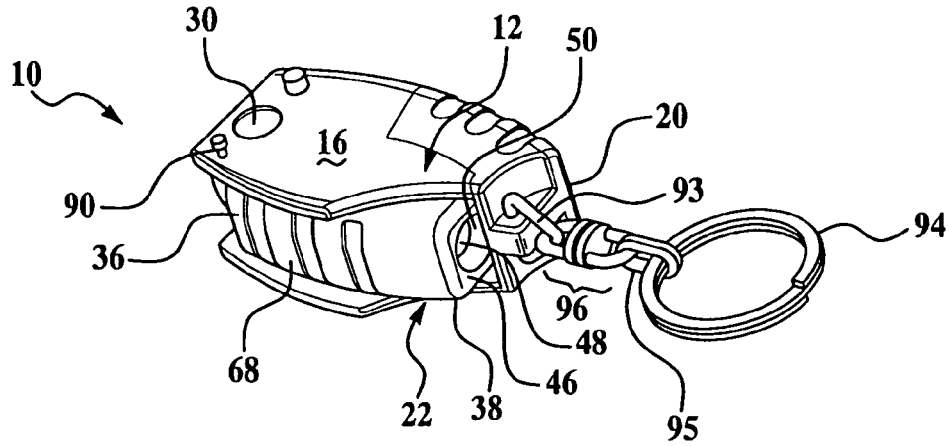
FIG. 2 is a perspective view of the inventive light depicted in FIG. 1.
Figure 3:
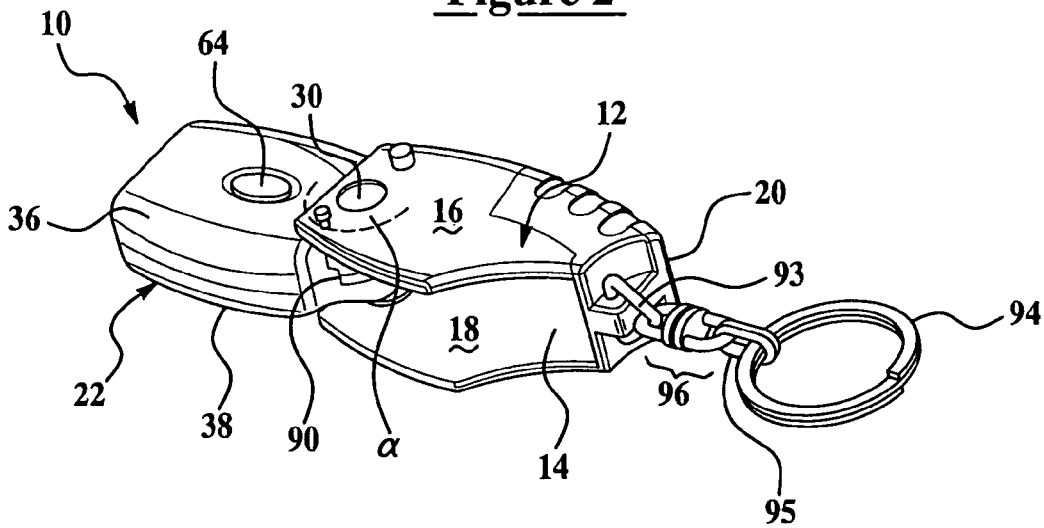
FIG. 3 is a perspective view of the light depicted in FIG. 1 in an open position.
Figure 4:
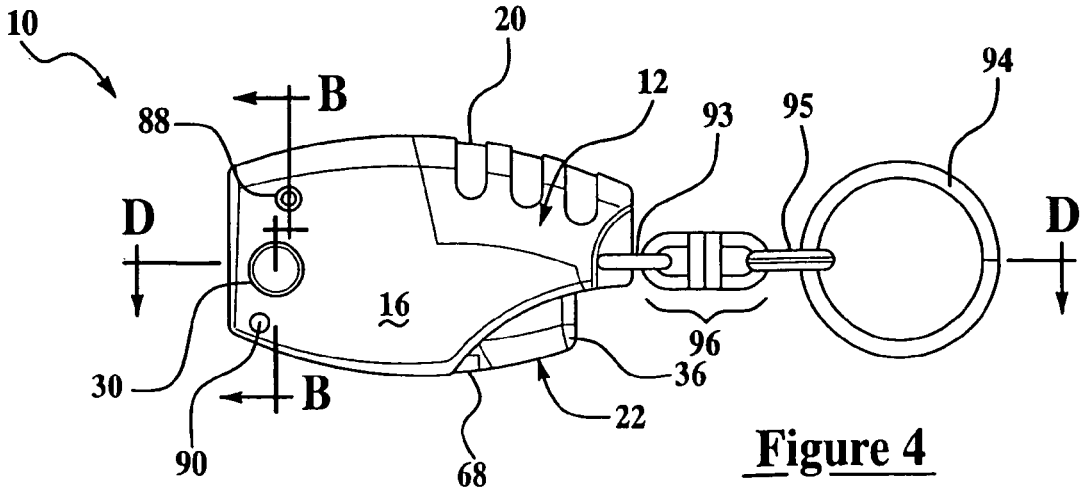
FIG. 4 is a top view of the inventive light depicted in FIG. 1.
Figure 5:
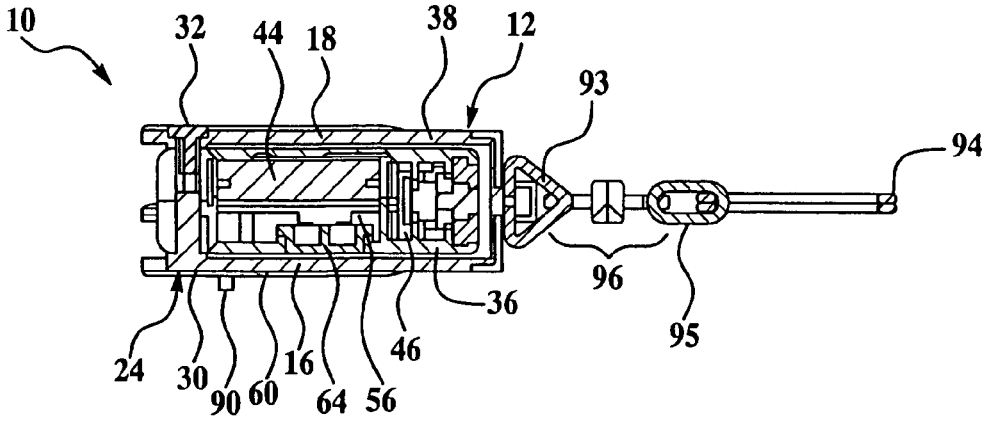
FIG. 5 is a cross-sectional view of the light depicted in FIG. 3 along line D-D.
Figure 6:
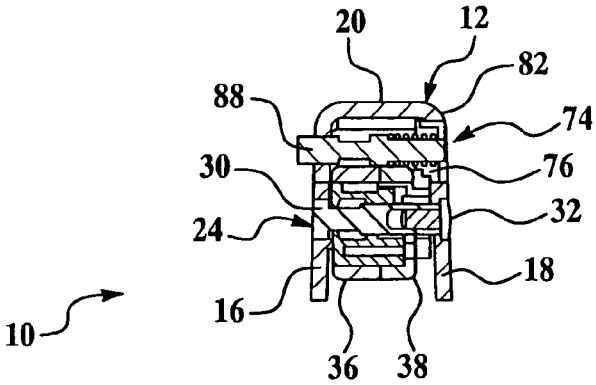
FIG. 6 is a cross-sectional view of the light depicted in FIG. 3 along line B-B.
Figure 7:
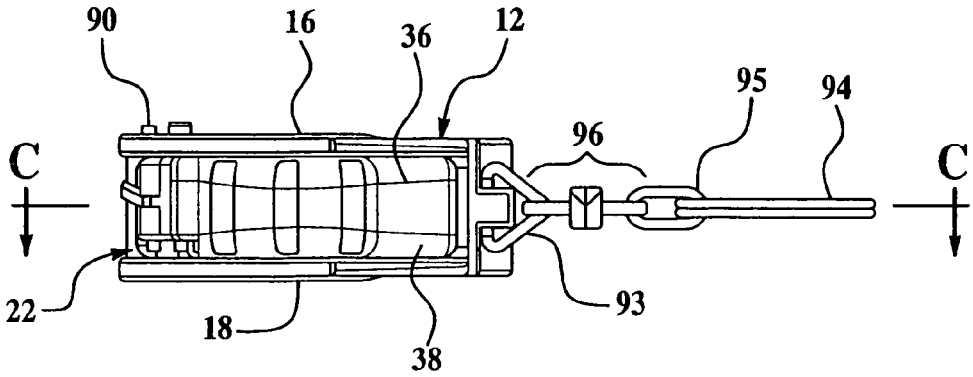
FIG. 7 is a side view of the light depicted in FIG. 1.
Figure 8:
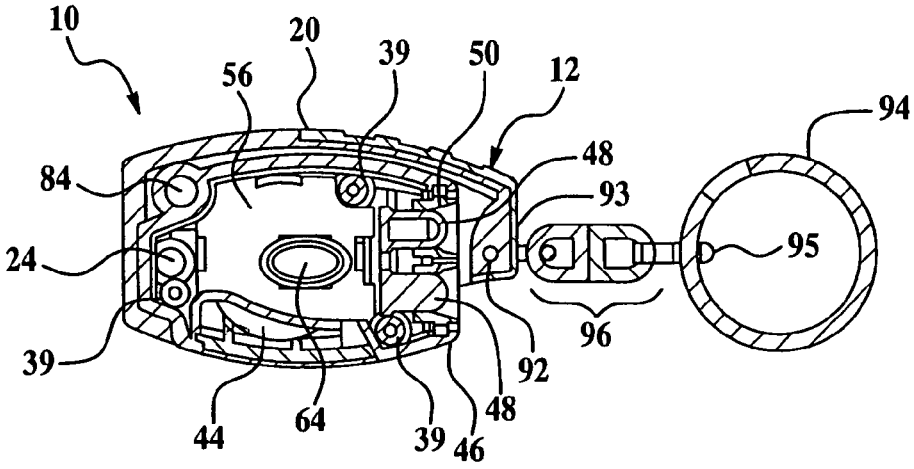
FIG. 8 is a transverse cross-sectional view of the light depicted in FIG. 6 along the line C-C.
Figure 9:
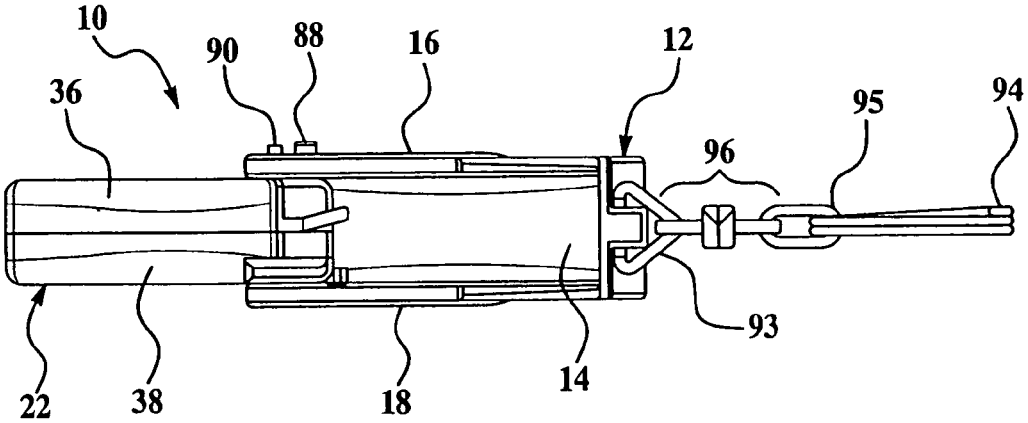
FIG. 9 is a side view of the light depicted in FIG. 6 in the open position.
Figure 10:
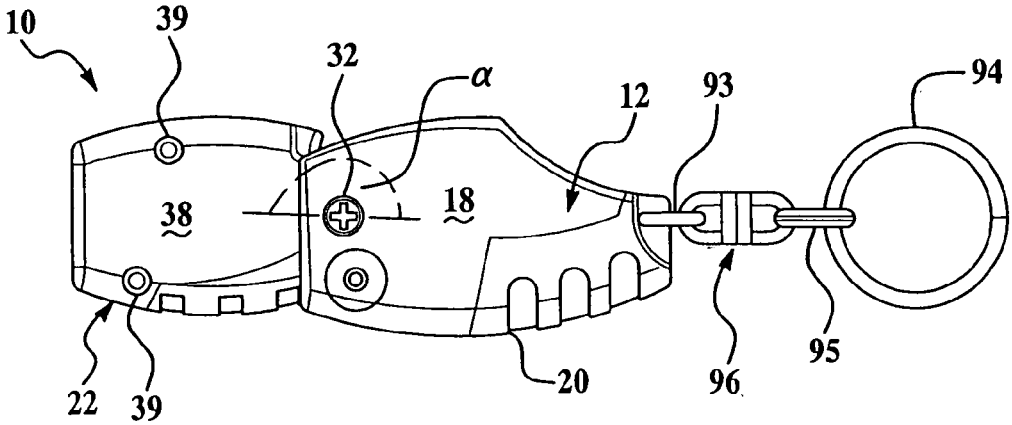
FIG. 10 is a bottom view of the light depicted in FIG. 1 in an open position.

Regardless of whether the inventive embodiment includes a spring-biased pivot pin and the accompanying flip switch mechanism 74, an inventive flashlight 10 optionally includes a set screw 90 extending through one of the surfaces 16 or 18 so as to retain a light assembly 22 in an angular position intermediate between a fully closed and fully open position as illustrated in FIGS. 1 and 2, respectively. According to the present invention, the angle $\alpha$ defined by the line extending through pivot pin 24 to the center of the light assembly in the closed position, as depicted by line D-D in the center of the light assembly 22 in the open position defines a flip angle $\alpha$. Typically, the flip angle $\alpha$ is between 80 and 200 degrees. Preferably, the flip angle $\alpha$ is greater than 140 degrees. Still more preferably, the flip angle $\alpha$ is between 160 and 190 degrees. Through the deployment of the set screw 90, an angle intermediate between 0 degrees and the flip angle $\alpha$ can be retained. Setting an angle intermediate between 0 degrees and the flip angle $\alpha$ is particularly well suited for retaining an inventive flashlight 10 in a user palm and directing a light beam in a particular direction while the user thumb and forefinger are deposed to retain a tool or key operative within the cone of light provided by the inventive flashlight 10.

To facilitate the use of an inventive flashlight 10 with a key or other small implement, the housing 12 optionally includes an aperture 92 adapted to receive a securement 20 therethrough. The securement 93 is in turn optionally coupled to a key ring 94. Preferably, an intermediate swivel 96 and link 95 mechanically connects the securement 93 with a key ring 94.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A flashlight comprising:

a housing;

a light assembly comprising a light source, a battery, and a light activation switch for selectively forming an electrical circuit between said light source and said battery to induce light emission from said light source;

a pivot engaging said housing and said light assembly, said light assembly, said light source and said switch rotating about said pivot relative to said housing between a closed position and an extended position through a flip angle of greater than 140 degrees; and a contact extending from said housing so as to to cause a first depression of said light activation switch upon said light assembly being rotated from a closed position to an open position to cause a subsequent second depression of said light activation switch from the open position to the closed position.

2. The flashlight of claim 1 further comprising a keychain coupled to said housing.

3. The flashlight of claim 2 further comprising a spring biasing said light assembly to the extended position.

4. The flashlight of claim 3 further comprising a flip switch retaining said light assembly in the closed position against bias imposed by said spring.

5. The flashlight of claim 4 wherein said contact extending from said housing depresses said light activation switch upon a release of said flip switch.

6. The flashlight of claim 5 wherein said contact is a roller bearing.

7. The flashlight of claim 1 further comprising a set screw extending through said housing and engaging said light assembly so as to secure said light assembly in a position intermediate between the closed position and the extended position.

8. The flashlight of claim 1 wherein the flip angle is between 160 and 190 degrees.

9. A flashlight comprising:

a housing;

a light assembly comprising a light source, a battery, and a light activation switch for selectively forming an electrical circuit between said light source and said battery to induce light emission from said light source;

a pivot engaging said housing and said light assembly, said light assembly rotating about said pivot relative to said housing between a closed position and an extended position through a flip angle of greater than 150 degrees; and a contact extending from said housing to depress said light activation switch upon said light assembly being rotated from the closed position to the extended position and from the extended position to the closed position.

10. The flashlight of claim 9 wherein said contact is a roller bearing.

11. flashlight of claim 9 further comprising a keychain coupled to said housing.

12. The flashlight of claim 11 further comprising a spring biasing said light assembly to the extended position.

13. The flashlight of claim 12 further comprising a flip switch retaining said light assembly in the closed position against bias imposed by said spring.

14. The flashlight of claim 9 further comprising a set screw extending through said housing and engaging said light assembly so as to secure said light assembly in a position intermediate between the closed position and the extended position.

15. A flashlight comprising:

a housing;

a light assembly comprising a light source, a battery, and a light activation switch for selectively forming an electrical circuit between said light source and said battery to induce light emission from said light source;

a pivot engaging said housing and said light assembly, said light assembly rotating about said pivot relative to said housing between a closed position and an extended position through a flip angle of greater than 150 degrees;

a set screw extending through said housing and engaging said light assembly so as to secure said light assembly in a position intermediate between the closed position and the extended position; and a contact extending from said housing to depress said light activation switch upon said light assembly being rotated from the closed position to the extended position or from the extended position to the closed position.

16. The flashlight of claim 15 further comprising a spring biasing said light assembly to the extended position.

17. The flashlight of claim 16 further comprising a flip switch retaining said light assembly in the closed position against bias imposed by said spring.

18. The flashlight of claim 17 wherein said contact extending from said housing depresses said light activation switch upon a release of said flip switch.

* * * * *